US005333026A

United States Patent [19]

Freeman

[11] Patent Number: 5,333,026

[45] Date of Patent: Jul. 26, 1994

[54] PHOTOGRAPHIC MATERIAL PROCESSOR

[75] Inventor: Barrie A. Freeman, Wilmslow, Great Britain

[73] Assignee: Ilford Limited, Cheshire, England

[21] Appl. No.: 934,173

[22] Filed: Aug. 21, 1992

[30] Foreign Application Priority Data

Sep. 4, 1991 [GB] United Kingdom ..... 9118883

[51] Int. Cl.[5] ..... G03D 3/02

[52] U.S. Cl. ..... 354/324

[58] Field of Search ..... 354/324, 319–323; 134/64 P, 64 R, 122 R, 122 P; 137/486, 487, 487.5, 624.11, 625; 222/1, 145, 136

[56] References Cited

U.S. PATENT DOCUMENTS

| | | | |
|---|---|---|---|
| 4,002,267 | 1/1977 | Aelterman et al. | 222/1 |
| 4,329,042 | 5/1982 | Libicky et al. | 354/324 |
| 4,999,660 | 3/1991 | Wright | 354/324 |
| 5,151,731 | 9/1992 | Yamada | 354/324 |

FOREIGN PATENT DOCUMENTS 9015362 12/1990 PCT Int'l Appl. ..... G03D 3/06

*Primary Examiner*—D. Rutledge
*Attorney, Agent, or Firm*—Darby & Darby

[57] ABSTRACT

A photographic material processor which having at least two processing tanks for solutions used in the processing of photographic material, and one positive displacement pump for each processing solution for transferring concentrated processing solution and water to said processing tanks, the processor also comprising means for connecting each pump to a concentrated solution container and to a water source by a two-way valve, means for measuring the area of photographic material processed and means for activating the said pumps when a predetermined area of photographic material has been processed to perform a replenishment cycle, means for directing the liquid flow in each two-way valve so that during each replenishment cycle a predetermined volume of concentrate processing solution and a predetermined volume of water are pumped to the processing tanks by each PUMP.

3 Claims, 1 Drawing Sheet

PHOTOGRAPHIC MATERIAL PROCESSOR

FIELD OF THE INVENTION

This invention relates to a photographic material processor wherein water and concentrated processing solutions are mixed to replenish the solution in each processing tank.

BACKGROUND OF THE INVENTION

Each piece or length of photographic material treated in a processing tank uses up a certain amount of the processing agent in the tank and as each piece or length of photographic material is taken out of each tank a certain volume of processing solution is taken out of the tank on the surfaces of the photographic material and by-products of processing are deposited in the processing tanks. Thus the strength of the processing solution as well as the volume of processing solution is reduced each time a piece or length of photographic material is processed in the tank. Often the photographic processor comprises a means to monitor the area of photographic material being processed and after a predetermined area has been processed, a solution replenishment cycle is initiated. The frequency of each replenishment cycle is so arranged that the strength of each solution in the processor is returned to the state before processing commenced.

In the past, when replenishing with solution concentrate and water, separate pumps have been used to supply each concentrated processing solution and the water. However, it has been found difficult to accurately adjust the volume of liquid dispensed by each pump during each replenishment cycle to ensure that each tank is replenished to the correct strength.

This is particularly true if the replenishment pumps are bellows pumps wherein problems are experienced associated with variations in the volume dispensed on each stroke of the bellows pump due to the effects of aging and wear of the plastic pump bellows.

Of more concern is the difficulty in adjusting two pump strokes to give adequate degree of accuracy to achieve a desired ratio, typically 1:3. Therefore the majority of systems utilize replenishment from premixed working strength solution, to avoid variations in concentration. But, this is time consuming to prepare such premixed solutions.

SUMMARY OF THE INVENTION

An object of the invention is thus to provide a film processor in which such adjustment is simply and correctly carried out.

Therefore, according to the present invention, there is provided a photographic material processor which comprises at least two processing tanks for solutions used in the processing of photographic material, and one positive displacement pump for each processing solution for transferring concentrated processing solution and water to said processing tanks, the processor being connected by each pump to a concentrated solution container and to a water source through a two-way valve. The processor measures the area of photographic material processed and then activates the pumps when a predetermined area of photographic material has been processed to perform a replenishment cycle. The liquid flow in each two-way valve is directed so that during each replenishment cycle a predetermined volume of concentrate processing solution and a predetermined volume of water are pumped to the processing tanks by each pump.

Preferably each positive displacement pump is a bellows pump.

Preferably the volume of liquid delivered by each stroke of the positive displacement pump can be individually preset.

Preferably the change over from water to concentrate is made at the extremity of the bellows stroke.

In one embodiment of the invention both pumps are connected to a single driving shaft so that in a replenishment cycle both the pumps are worked simultaneously.

In a modification of this embodiment means are provided for disengaging one or both pumps from the driving shaft. Thus if the need arises during one particular replenishment cycle only one processing tank is replenished.

BRIEF DESCRIPTION OF THE DRAWINGS

The foregoing and other objects and advantages will become apparent to those skilled in the art upon reading the following detailed description of the preferred embodiments in conjunction with a review of the appended drawing, in which.

DETAILED DESCRIPTION OF THE PREFERRED EMBODIMENTS

Figure 1:
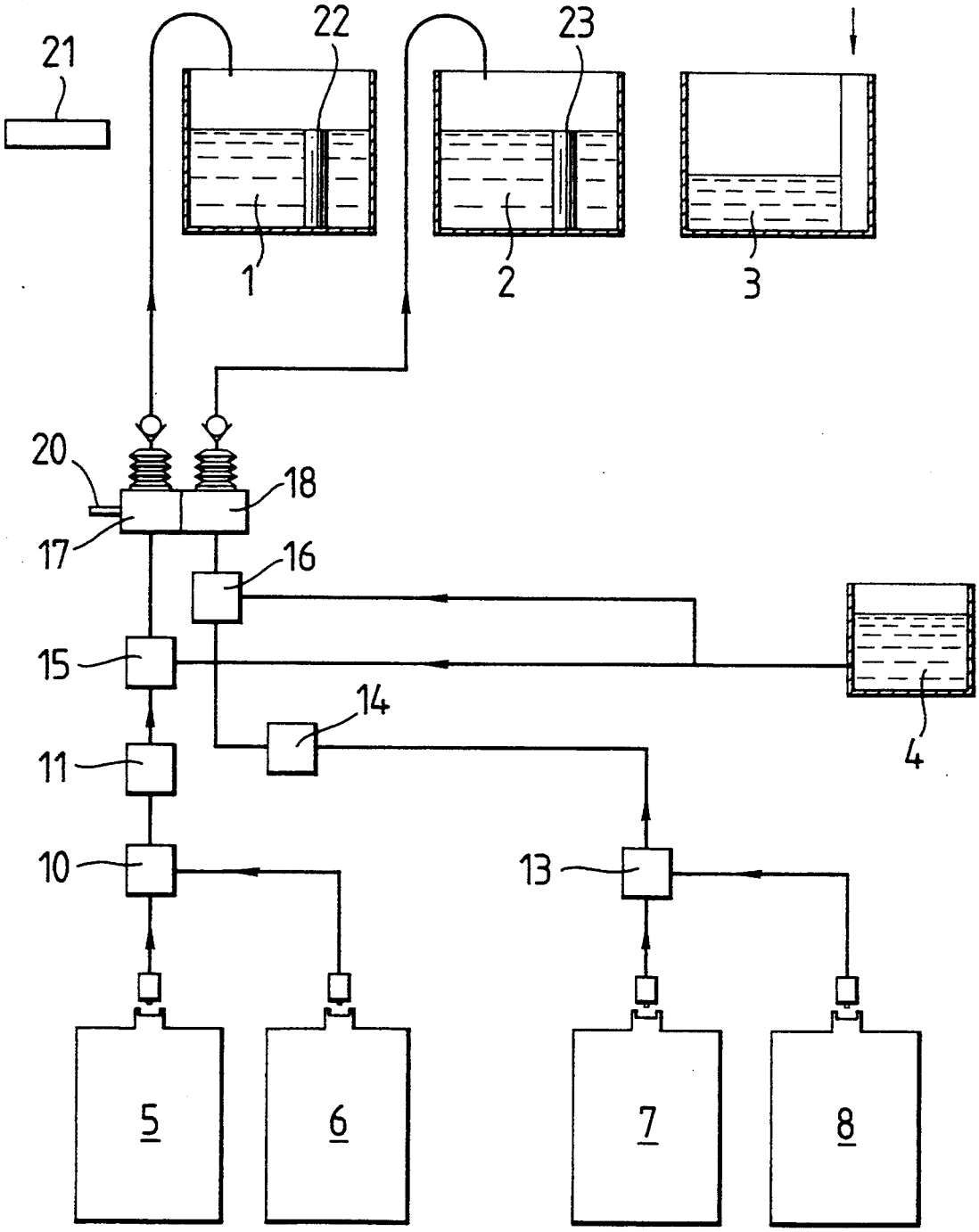
FIG. 1 is a diagrammatic side view of one photographic material processor according to the present invention.

The processor comprises a developing solution tank 1, a fixing solution tank 2 and a water wash tank 3. Each of the tanks 1 and 2 comprises working strength solutions into which the photographic material is fed; first into tank 1, then tank 2 and finally wash tank 3. The photographic material is present in tank 1 for sufficient time for the image on the material to be correctly developed, in tank 2 for sufficient time for the unexposed silver halide to be fixed out and in wash tank 3 for sufficient time for the dissolved silver halide to be removed from the photographic material. Concentrated developer solution is stored in containers 5 and 6 and concentrated fixing solution is stored in containers 7 and 8 and water is stored in tank 4.

The concentrated developer solution containers 5 and 6 are connected by pipes to a two-way valve 10 above which is located a flow detector 11. When either container 5 or 6 is empty and a no-solution state is detected by the detector 11, the position of the two-way valve 10 is changed to draw solution from the container which still contains solution and provides a warning of the empty container. Similarly, each fixing solution container 7 and 8 is connected to a two-way valve 13 which is connected to a flow detector 14. Above the flow detectors 11 and 14 are located two-way valves 15 and 16 which control the addition of either one of the chemical or water from tank 4. Above valve 15 is a bellows pump 17 and above valve 16 is a bellows pump 18. Each pump is actuated by the driving shaft 20 which is driven by a motor (not shown).

A photographic material area counter 21 monitors the area of photographic material being processed and initiates the replenishing cycle.

Information will have been provided by the manufacturer of the photographic material being processed which indicates how much developing solution and fixing solution are required to replenish tanks 1 and 2 after each, for example, one square meter of photographic material has been processed, in order to maintain the working concentration of the developer and fixing solutions. This establishes replenishment rates. Overflow pipe 22 in tank 1 and overflow pipe 23 in tank 2 are shown in FIG. 1.

It is possible to alter four variables to ensure correct replenishment of the processing solution during each replenishment cycle. These are 1) the volume of liquid pumped into the processing tanks for each stroke of the bellows pump, 2) the number of pump strokes during each replenishment cycle—this controls the total volume of liquid pumped to the processing tanks during each replenishment cycle, 3) the operation of the three-way valves 15 and 16 to determine the ratio of water and concentrated solution delivered to the processing tanks during each replenishment cycle—this controls replenisher concentration and 4) The area of paper required to trigger a replenishment cycle—this gives control of the replenishment rate of the replenisher solution.

It is most important to ensure that the concentration of active ingredients are maintained both in the developer tank and the fixing tank 2. The maximum liquid level in each tank is regulated by the height of the overflow pipes in each tank.

For example under one typical set of conditions it was found that after processing 1 $m^2$ of photographic material, it was necessary to replenish the developing tank 1 with 120 ml of developing solution which comprised 30 ml of concentrated developer solution and 90 ml of water diluent. Fixing tank 2 needed 200 ml of fixing solution which comprised 50 ml concentrated fixing solution and 150 ml water diluent. This meant that the processor was set up so that a replenishment cycle was initiated after every 1 $m^2$ of material had been processed. Pump 17 was adjusted so that it delivered 30 ml of liquid every time the bellows pump was activated. Pump 18 was adjusted so that it delivered 50 ml of liquid every time the bellows pump was activated. Thus during each replenishment cycle shaft 20 was rotated four times and two-way valve 15 was set so that for three of the revolutions water from the storage tank 4 was pumped by pump 17 into tank 1. This meant 90 ml of water was delivered to tank 1 and for one revolution 30 ml developer concentrate from either container 5 or 6 was pumped to tank 1. Thus one part of developer concentrate and three parts of water was delivered to tank 1. Similarly during each replenishment cycle two-way valve 16 was set so that for three of the revolutions, water from the storage tank 4 was pumped by pump 18 into tank 2. This meant that 150 ml of water was delivered to tank 1 and for one revolution fixing concentrate from either container 7 or 8 was delivered to tank 2. Therefore one part of fixing concentrate and three parts of water was delivered to tank 2.

Usually more fixing solution has to be supplied during a replenishment cycle than developer in order to remove the silver deposited in the fix solutions. By adjusting the four variables as just set forth it is possible to keep the working strength of both the developer solution and the fixing solution within the required limits. It is also possible to adjust the total supply of liquid to the developer tank 1 so that only a minimum overflow is obtained, thus reducing waste of the developer solution.

What is claimed is:

1. A photographic material processor having at least two processing solution tanks used in the processing of photographic material, and one positive displacement pump for each processing solution tank for transferring concentrated processing solutions and water to said processing tanks, the processor comprising:

means for connecting each pump to a concentrated solution container and to a water source;

means for measuring the area of photographic material processed;

means for activating said pumps when a predetermined area of photographic material has been processed to perform a replenishment cycle; and means for controlling said means for connecting so that during each replenishment cycle a first predetermined volume of concentrate processing solution and a second predetermined volume of water are pumped to each of said processing tanks by each pump, said controlling means being operable to individually set both said first predetermined volume of concentrate and said second predetermined volume of water.

2. A photographic material processor according to claim 1 wherein each positive displacement pump is a bellows pump.

3. A photographic material processor according to claim 1 wherein said pumps are connected to a single driving shaft so that said pumps work simultaneously.

* * * * *